US009330871B2

(12) United States Patent
Uchiyama et al.

(10) Patent No.: US 9,330,871 B2
(45) Date of Patent: May 3, 2016

(54) RELAY

(71) Applicant: FUJITSU COMPONENT LIMITED, Tokyo (JP)

(72) Inventors: Takuya Uchiyama, Tokyo (JP); Nobuo Yatsu, Tokyo (JP); Natsumi Sakai, Tokyo (JP); Kohei Takahashi, Tokyo (JP); Katsuaki Koshimura, Tokyo (JP); Masahiro Kaneko, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 16 days.

(21) Appl. No.: 14/082,513

(22) Filed: Nov. 18, 2013

(65) Prior Publication Data

US 2014/0145805 A1 May 29, 2014

(30) Foreign Application Priority Data

Nov. 29, 2012 (JP) ..... 2012-261357

(51) Int. Cl.

| | |
|---|---|
| ***H01H 51/22*** | (2006.01) |
| ***H01H 50/28*** | (2006.01) |
| ***H01H 50/34*** | (2006.01) |
| ***H01H 50/64*** | (2006.01) |
| *H01H 50/56* | (2006.01) |

(52) U.S. Cl.

CPC ..... *H01H 50/28* (2013.01); *H01H 50/34* (2013.01); *H01H 50/643* (2013.01); *H01H 50/56* (2013.01); *H01H 50/644* (2013.01)

(58) Field of Classification Search

CPC ..... H01H 13/32; H01H 15/102
USPC ..... 335/78
See application file for complete search history.

(56) References Cited

U.S. PATENT DOCUMENTS

| | | | | | |
|---|---|---|---|---|---|
| 1,047,372 | A | * | 12/1912 | Bickford | 200/469 |
| 1,839,377 | A | * | 1/1932 | Daly | 335/125 |
| 2,262,306 | A | * | 11/1941 | Thompson | 200/6 BB |
| 2,957,970 | A | * | 10/1960 | Taylor | 200/244 |
| 3,192,329 | A | * | 6/1965 | Murrle | 200/16 A |
| 3,627,937 | A | * | 12/1971 | Swanke et al. | 200/38 B |
| 3,823,280 | A | * | 7/1974 | Obermann et al. | 200/38 B |
| 4,792,702 | A | * | 12/1988 | Masaki | 307/112 |
| 5,182,461 | A | * | 1/1993 | Baran | 307/41 |

FOREIGN PATENT DOCUMENTS

| | | |
|---|---|---|
| JP | 61-151242 | 9/1986 |
| JP | 63-126131 | 5/1988 |

(Continued)

OTHER PUBLICATIONS

Patent Abstracts of Japan, Publication No. 5-250950, Published Sep. 28, 1993.

*Primary Examiner* — Alexander Talpalatski
(74) *Attorney, Agent, or Firm* — Staas & Halsey LLP

(57) ABSTRACT

A relay includes: a fixed terminal on which a fixed contact is provided; a movable terminal on which a movable contact is provided; a cam that has an elliptical circumference shape, and is rotatable while a portion of the circumference shape is contacting a surface of the movable terminal; and a driving unit that rotates the cam so that respective portions located at one ends of a major axis and a minor axis of the elliptical circumference shape alternately contact the surface of the movable terminal; wherein when the portion located at one end of the major axis of the elliptical circumference shape of the cam contacts the surface of the movable terminal, the movable terminal is deformed elastically so that the movable contact contacts the fixed contact.

20 Claims, 28 Drawing Sheets

(56) References Cited

FOREIGN PATENT DOCUMENTS

| | | |
|---|---|---|
| JP | 63-126132 | 5/1988 |
| JP | 64-7555 | 2/1989 |
| JP | 5-250950 | 9/1993 |
| JP | 6-5087 | 1/1994 |

* cited by examiner

RELAY

CROSS-REFERENCE TO RELATED APPLICATION

This application is based upon and claims the benefit of priority of the prior Japanese Patent Application No. 2012-261357 filed on Nov. 29, 2012, the entire contents of which are incorporated herein by reference.

FIELD

A certain aspect of the embodiments is related to a relay.

BACKGROUND

A relay moves a movable contact provided on a tip of a plate spring by a suction force of a magnetic field generated when a current flows through a coil, and contacts the movable contact and a fixed contact. For this reason, in order to maintain a contact state, the relay needs to continue flowing the current and consumes an electric power continuously. Moreover, there is a problem that the contact state (i.e., ON state) of both contacts cannot be maintained at the time of a power failure.

For example, Japanese Laid-open Patent Publication No. 5-250950 and Japanese Unexamined Utility Model Publication No. 61-151242 disclose that a cam is rotated by exciting a coil, and a movable contact and a fixed contact are contacted mutually, with respect to a relay On the contrary, a relay called a latching relay or the like can maintain a contact state by using a permanent magnet, a ratchet mechanism, or the like, without flowing a current. Therefore, the latching relay can reduce power consumption, and maintain the contact state at the time of power failure.

With respect to the latching relay, Japanese Unexamined Utility Model Publication No. 6-5087 discloses that a switch is configured so that a pair of contact boards repeats a contact state and a non-contact state whenever a coil of an electromagnetism plunger is energized by using a ratchet mechanism. Japanese Laid-open Patent Publication No. 63-126131, Japanese Laid-open Patent Publication No. 63-126132, and Japanese Examined Utility Model Publication No. 64-7555 disclose a relay which includes a lever that is pivotally mounted to a movable iron core, a latch receiver that is pivotally mounted to one end of the lever, a latch base that guides the movement of the latch receiver, a latch that is pivotally mounted to the latch base, and one end of the latch being engaged with the latch receiver.

SUMMARY

According to an aspect of the present invention, there is provided a relay including: a fixed terminal on which a fixed contact is provided; a movable terminal on which a movable contact is provided; a cam that has an elliptical circumference shape, and is rotatable while a portion of the circumference shape is contacting a surface of the movable terminal; and a driving unit that rotates the cam so that respective portions located at one ends of a major axis and a minor axis of the elliptical circumference shape alternately contact the surface of the movable terminal; wherein when the portion located at one end of the major axis of the elliptical circumference shape of the cam contacts the surface of the movable terminal, the movable terminal is deformed elastically so that the movable contact contacts the fixed contact.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

First Embodiment

Figure 1:
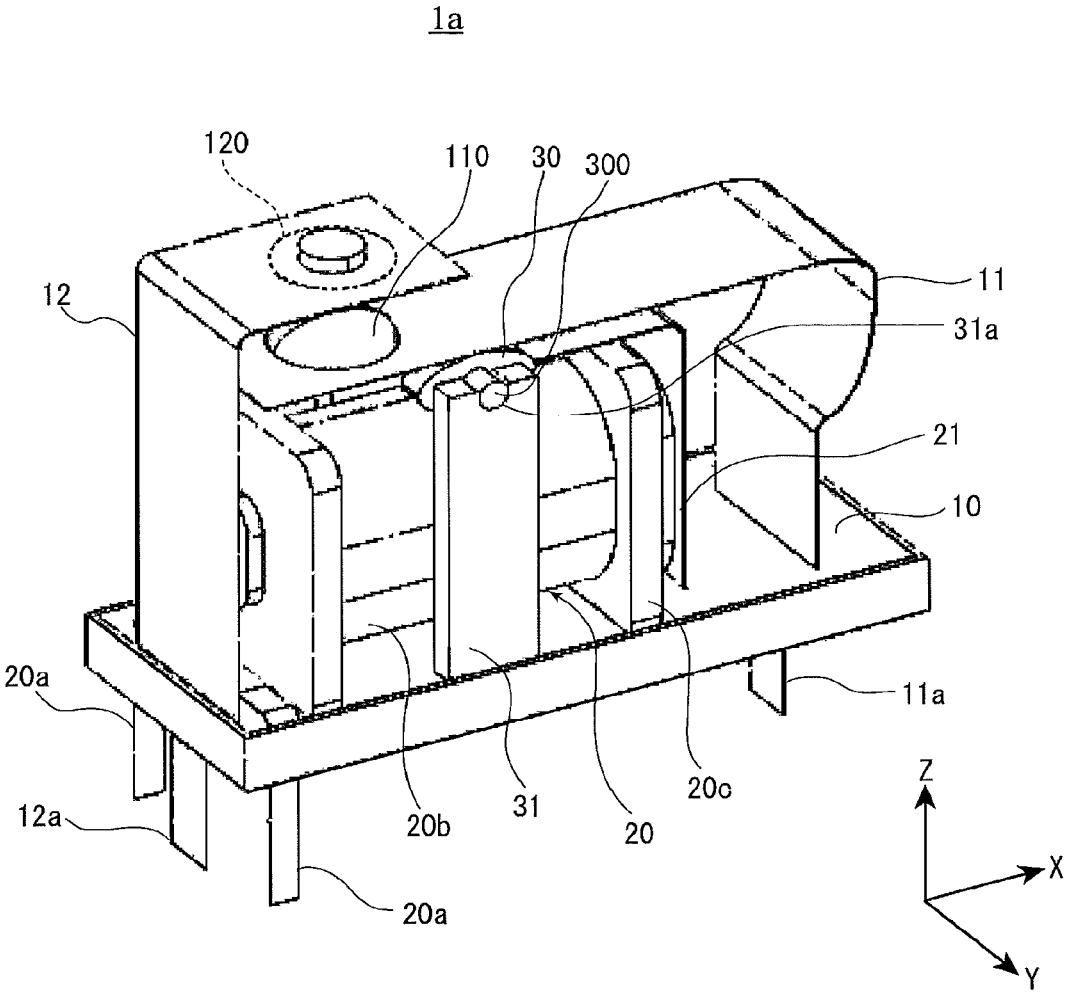
FIG. 1 is a perspective view of a relay according to a first embodiment.
Figure 2:
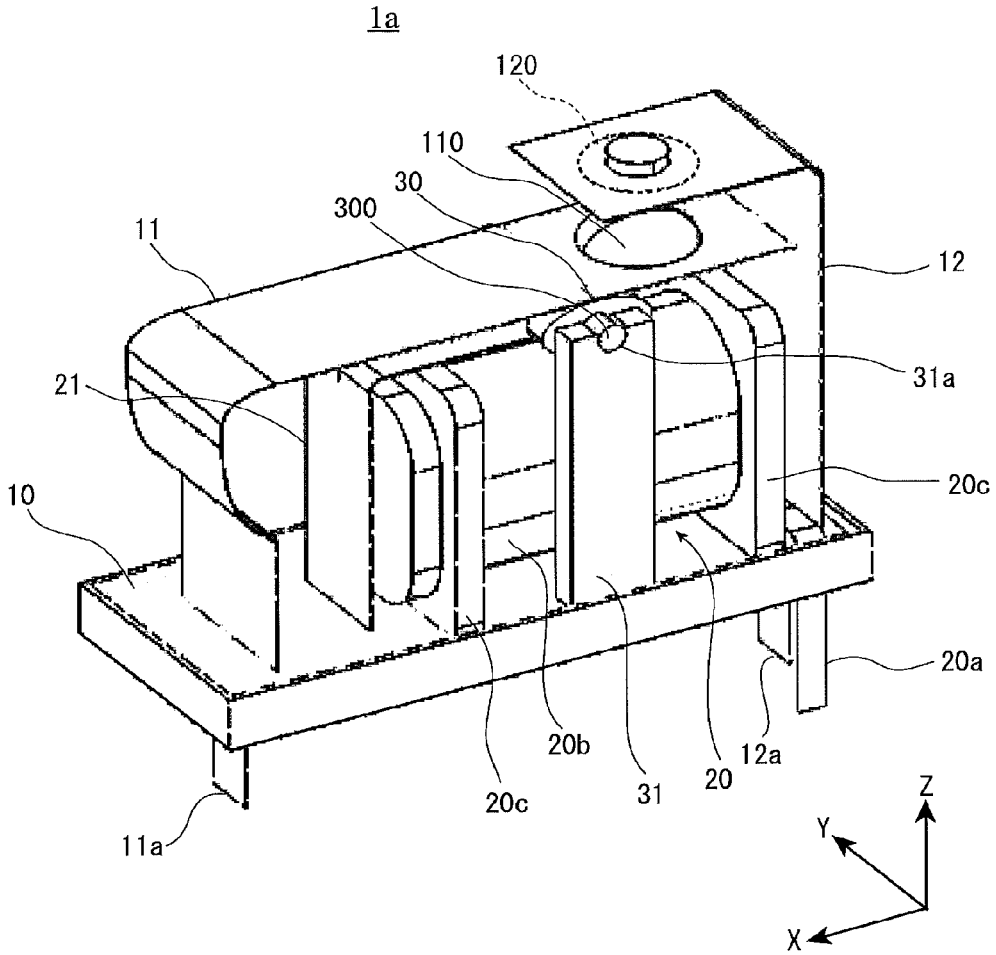
FIG. 2 is a perspective view of the relay according to the first embodiment, as viewed from an opposite side of FIG. 1.

FIG. 1 is a perspective view of a relay according to a first embodiment. FIG. 2 is a perspective view of the relay according to the first embodiment, as viewed from an opposite side of FIG. 1. A relay 1*a* includes a base 10, a movable terminal 11, a fixed terminal 12, a coil 20, an extrusion member 21, a pair of cams 30, and a pair of pillars 31. Here, directions of an X-axis, a Y-axis and a Z-axis illustrated in FIGS. 1 and 2 are defined as a front-and-back direction, a right-and-left direction, and an up-and-down direction, respectively.

The base 10 supports the movable terminal 11, the fixed terminal 12, the coil 20, the extrusion member 21, and the pair of pillars 31. The base 10 is formed, for example in the shape of a rectangle board by an insulator, such as rubber.

The coil 20 includes a pair of terminals 20*a*, a winding unit 20*b*, and a pair of flange units 20*c*. The winding unit 20*b* is provided between the pair of flange units 20*c* fixed to the base 10, and is configured so that a conductive wire is wound around the circumference of a core. Both ends of the conductive wire of the winding unit 20*b* are electrically connected to the pair of terminals 20*a* projected from an undersurface side of the base 10. Therefore, the coil 20 generates a magnetic field by energization from the pair of terminals 20*a*. The magnetic field acts as a suction force to attract the extrusion member 21 to a rear of the coil 20.

The fixed terminal 12 is an L-shaped conductive board stood on the base 10. An external connection terminal 12*a* extending from one end of a lower part of the fixed terminal 12 passes through the base 10 and is projected from the undersurface side of the base 10. Moreover, a dome-shaped fixed contact 120 is provided under a board surface of the fixed terminal 12 parallel to the base 10.

The movable terminal 11 is an L-shaped conductive board stood on the base 10. An external connection terminal 11*a* extending from one end of a lower part of the movable terminal 11 passes through the base 10 and is projected from the undersurface side of the base 10. Moreover, a dome-shaped movable contact 110 is provided on a board surface of the movable terminal 11 parallel to the base 10 so as to be opposed to the fixed contact 120. The movable contact 110 moves upward by elastic deformation of the movable terminal 11, and contacts the fixed contact 120.

The pair of cams 30 is supported by the pair of pillars 31 stood on the base 10. A rotary shaft 300 of the pair of cams 30 is fitted in concave portions 31*a* provided on the surfaces of the upper ends of the pillars 31. Each of the pair of cams 30 is a pillar-shaped member having an elliptical circumference shape, and can rotate while a portion of an outer circumferential surface of each cam 30 is contacting the board surface of the movable terminal 11. The movable contact 110 and the fixed contact 120 become a contact state or a non-contact state according to the rotational operation of the cams 30, so that the relay 1*a* is switched on or off.

Figure 3:
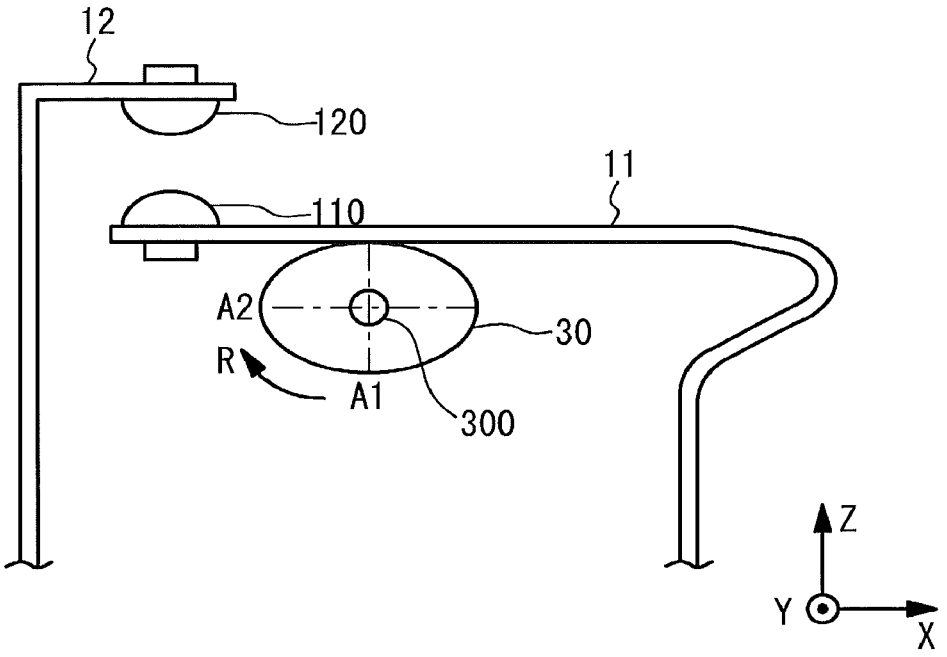
FIG. 3 is a side view illustrating a fixed terminal, a movable terminal, and cams when the relay is in an off-state.

FIG. 3 is a side view illustrating the fixed terminal 12, the movable terminal 11, and the cams 30 when the relay 1*a* is in an off-state. A portion of each cam 30 located at one end of a minor axis A1 of the elliptical circumference shape contacts the board surface of the movable terminal 11. At this time, the movable contact 110 is away from the fixed contact 120 at a given interval and opposed to the fixed contact 120. When the relay 1*a* is turned on, the cams 30 rotate by 90 degrees in a R-direction.

Figure 4:
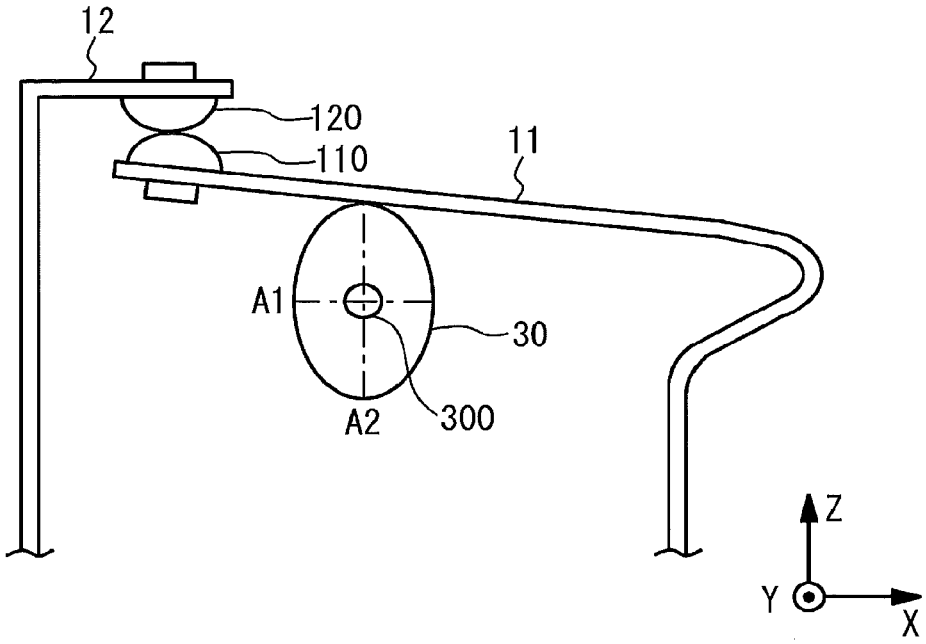
FIG. 4 is a side view illustrating the fixed terminal, the movable terminal, and the cams when the relay is in an on-state.

On the contrary, FIG. 4 is a side view illustrating the fixed terminal 12, the movable terminal 11, and the cams 30 when the relay 1*a* is in an on-state. A portion of each cam 30 located at one end of a major axis A2 of the elliptical circumference shape contacts the board surface of the movable terminal 11. The movable terminal 11 is pushed upward by the cams 30, and is deformed elastically. As a result, the movable contact 110 moves upward and contacts the fixed contact 120, so that the relay 1*a* becomes the on-state. Although in the present embodiment, the on-state and the off-state of the relay 1*a* are switched by the pair of cams 30, a single cam may be used for switching the state of the relay 1*a*.

Thus, when the portion located at one end of the major axis A2 of the elliptical circumference shape of each cam 30 contacts the movable terminal 11, the movable contact 110 is deformed elastically so as to contact the fixed contact 120. Here, a bending portion of the movable terminal 11 swells outwardly so that it is easy to transform the movable terminal 11.

Figure 5:
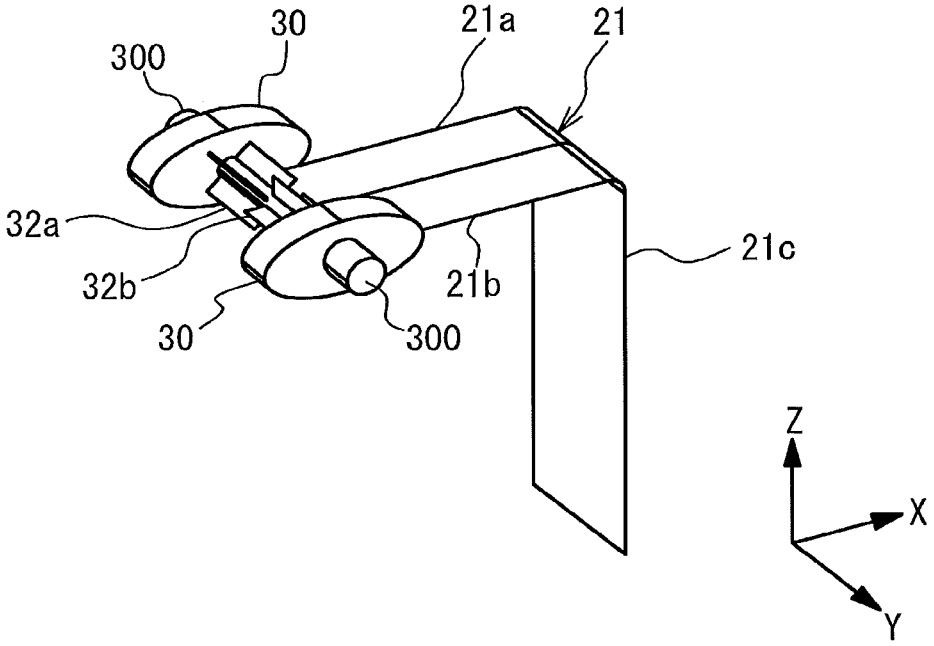
FIG. 5 is a perspective view of a driving mechanism of the cams.
Figure 6:
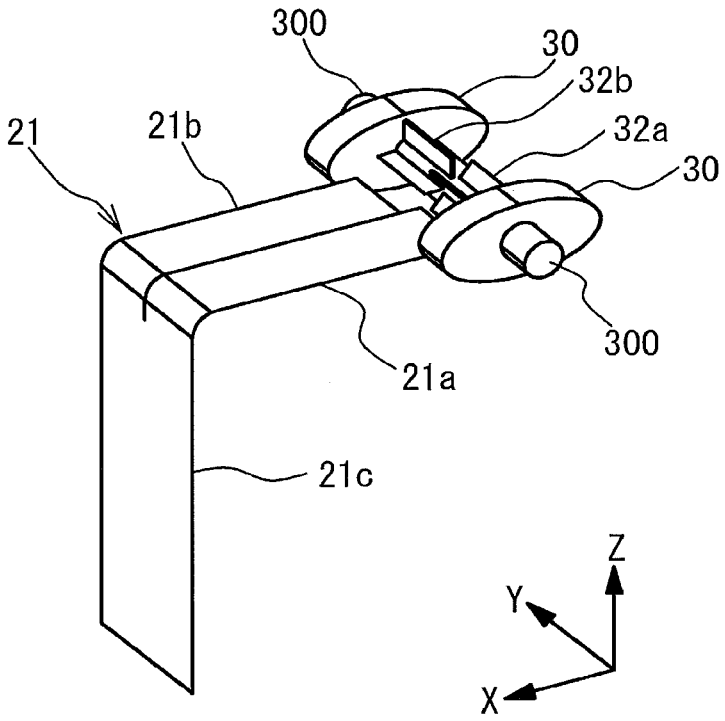
FIG. 6 is a perspective view of the driving mechanism of the cams, as viewed from an opposite side of FIG. 5.

FIG. 5 is a perspective view of a driving mechanism of the cams 30. FIG. 6 is a perspective view of the driving mechanism of the cams 30, as viewed from an opposite side of FIG. 5. The cams 30 rotate by extrusion operation of the extrusion member 21 stood by the base 10.

The extrusion member 21 is an L-shaped tabular member, and has elasticity and conductivity. The extrusion member 21 has two extrusion units 21*a* and 21*b*, and the movable unit 21*c*. The movable unit 21*c* is perpendicularly provided on the base 10, is attracted by the suction force generated from the coil 20, and inclines backward. Each of the two extrusion units 21*a* and 21*b* is extended from the movable unit 21*c*, and is provided in parallel with the base 10. The extrusion unit 21*a* is longer than the extrusion unit 21*b*.

The cams 30 are equipped with two impellers 32*a* and 32*b* rotatably attached to the rotary shaft 300. The two impellers 32*a* and 32*b* are adjacent to each other and provided between the pair of cams 30.

Figure 7:
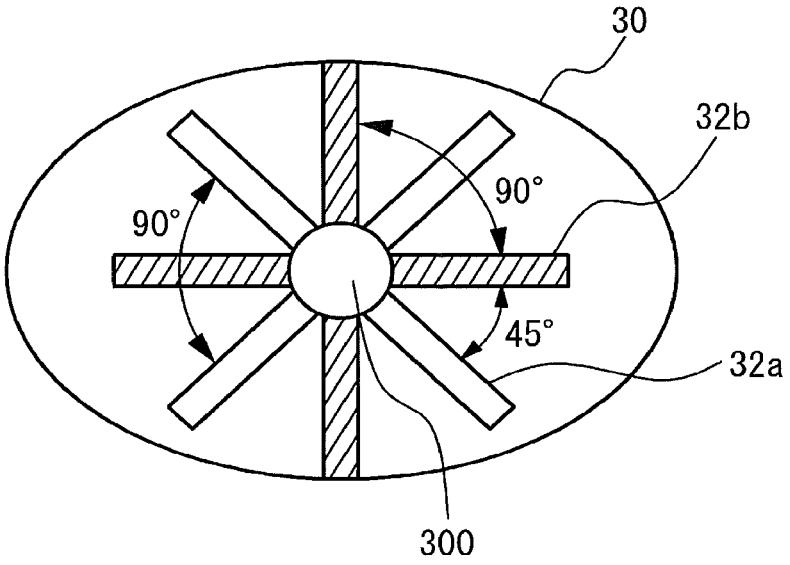
FIG. 7 is a side view of impellers provided between the cams.

FIG. 7 is a side view of the impellers 32*a* and 32*b* provided between the cams 30. Each of the impellers 32*a* and 32*b* has four blades provided at intervals of 90 degrees. The impellers 32*a* and 32*b* are configured so that each of intervals between the blades of the impeller 32*a* and the blades of the impeller 32*b* is 45 degrees. The four blades of the impeller 32*b* are provided along the minor axis A1 and the major axis A2 of the cams. Ones of the respective four blades are pushed from the two extrusion units 21*a* and 21*b*, so that the two impellers 32*a* and 32*b* rotate. It is desirable that the lengths of the blades of the respective impellers 32*a* and 32*b* are the same as each other.

Figure 8:
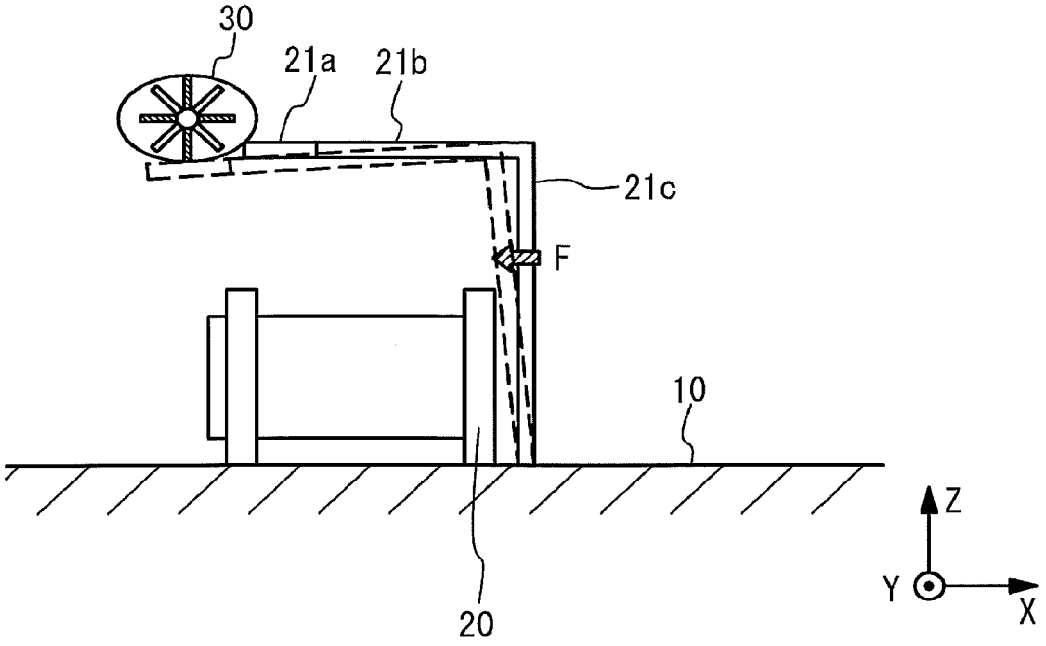
FIG. 8 is a side view illustrating the operation of an extrusion member.

FIG. 8 is a side view illustrating the operation of the extrusion member 21. The extrusion member 21 is deformed elastically by the suction force F generated whenever the coil 20 is energized, and hence the extrusion member 21 pushes the blades of the impellers 32*a* and 32*b* so that the impellers 32*a* and 32*b* are rotated by 90 degrees.

More specifically, the movable unit 21*c* inclines toward the coil 20 by the suction force F, as illustrated by a dotted line. According to this, the two extrusion units 21*a* and 21*b* also move backward, hit the blades of the impellers 32*a* and 32*b*, respectively, and rotate the impellers 32*a* and 32*b*. The coil 20 and the extrusion member 21 (i.e., a driving unit) rotate the cams 30 so that the respective portions of each cam 30 located at one ends of the major axis A2 and the minor axis A1 of the elliptical circumference shape alternately contact the board surface of the movable terminal 11.

Figure 9:
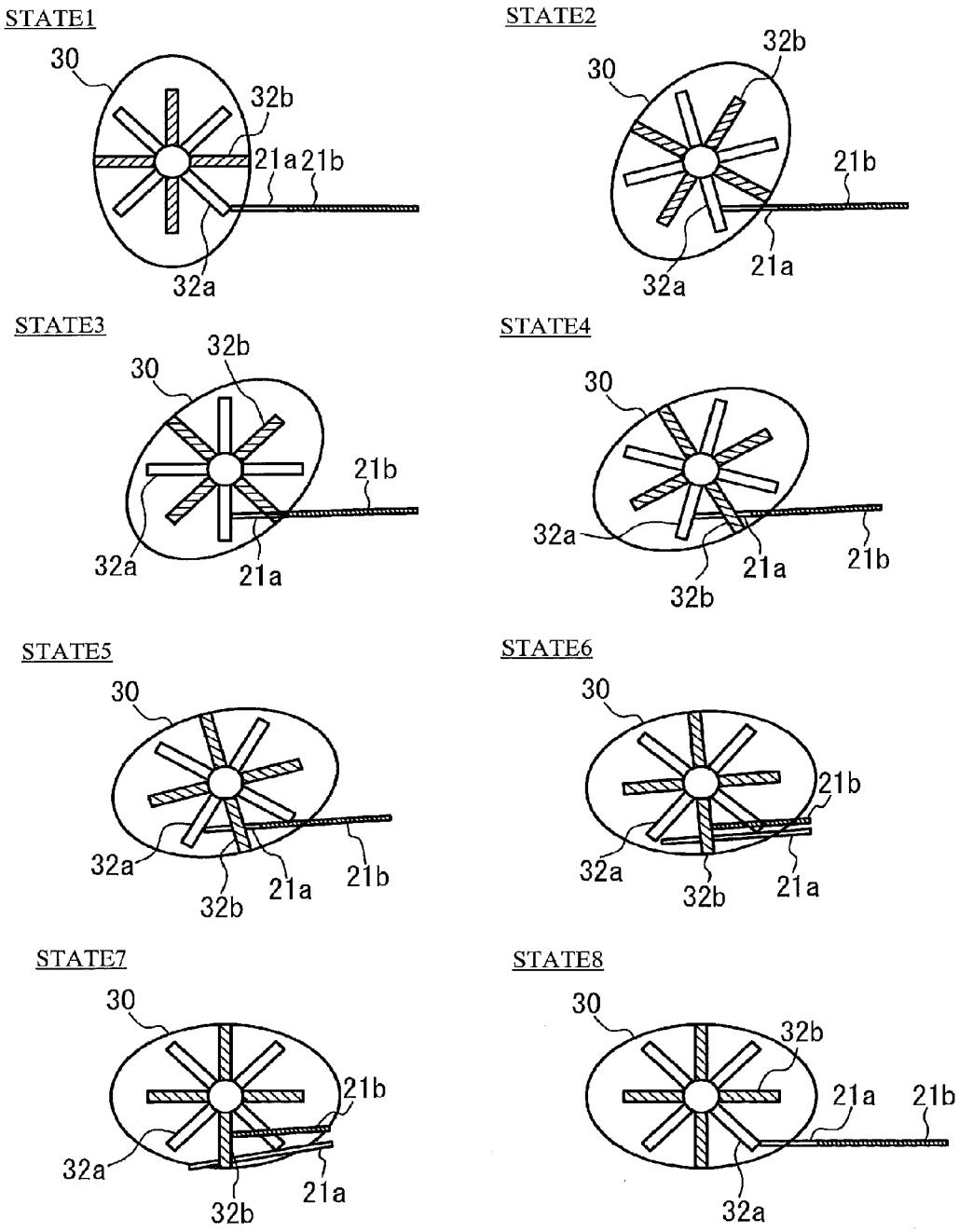
FIG. 9 is a side view illustrating the operation of the cams stepwise.

FIG. 9 is a side view illustrating the operation of the cams 30 stepwise. States 1 to 8 illustrated in FIG. 9 sequentially indicate a situation where the relay 1*a* is changed from the on-state (see FIG. 4) to the off-state (see FIG. 3). Also when the relay 1*a* is changed from the off-state to the on-state, the same operation procedures are performed.

When the coil 20 is energized, the two extrusion units 21*a* and 21*b* begin to move backward, and a front edge of the long extrusion unit 21*a* hits one of the blades of the impeller 32*a* in the state 1. Then, in the states 2 to 6, the extrusion unit 21*a* pushes the one of the blades of the impeller 32*a* to rotate the cams 30. At this time, the angle in which the cams 30 have rotated does not reach 90 degrees.

In the state 6, the extrusion unit 21*a* is pushed down from the blade next to the blade which the extrusion unit 21*a* is pushing, and begins to curve. The short extrusion unit 21*b* hits one of the blades of the impeller 32*b*.

In the state 7, the extrusion unit 21*a* further curves, and hence the extrusion unit 21*a* separates from the pushed blade. The short extrusion unit 21*b* pushes one of the blades of the impeller 32*b*, and rotates the cams 30. Thereby, the angle in which the cams 30 have rotated reaches 90 degrees.

In the state 8, when the energization to the coil is stopped, the suction force F is vanished, and the extrusion member 21 returns to an original given position (i.e., a position illustrated by a solid line of FIG. 8) by a restoring force. Therefore, the extrusion unit 21*b* separates from the pushed blade.

Thus, the two extrusion units 21*a* and 21*b* having different lengths are pushed against the two impellers 32*a* and 32*b* in which the angles of the blades are mutually shifted, so that the cams 30 can be easily rotated by 90 degrees. Although in the present embodiment, the two impellers 32*a* and 32*b* are used for the rotation of the cams 30, a single impeller may be used. Instead of the impellers 32*a* and 32*b*, another rotary driving mechanism, such as a gear, may be employed. In the present embodiment, the rotary angle for each energization of the coil 20 is 90 degrees, but the rotary angle is not limited to this. The rotary angle may be set to a suitable angle, according to an angle between the blades of the impellers 32*a* and 32*b* and each of the lengths of the extrusion units 21*a* and 21*b*, and so on.

The cams 30 properly adjust friction between the respective portions of each cam 30 located at one ends of the major axis A2 and the minor axis A1 of the elliptical circumference shape and the board surface of the movable terminal 11, so that the cams 30 can stably maintain the states 1 and 8 of FIG. 9. That is, the relay 1*a* maintains the off-state (see FIG. 3) and the on-state (see FIG. 4) by a friction force generated between the cams 30 and the movable terminal 11.

Figure 10:
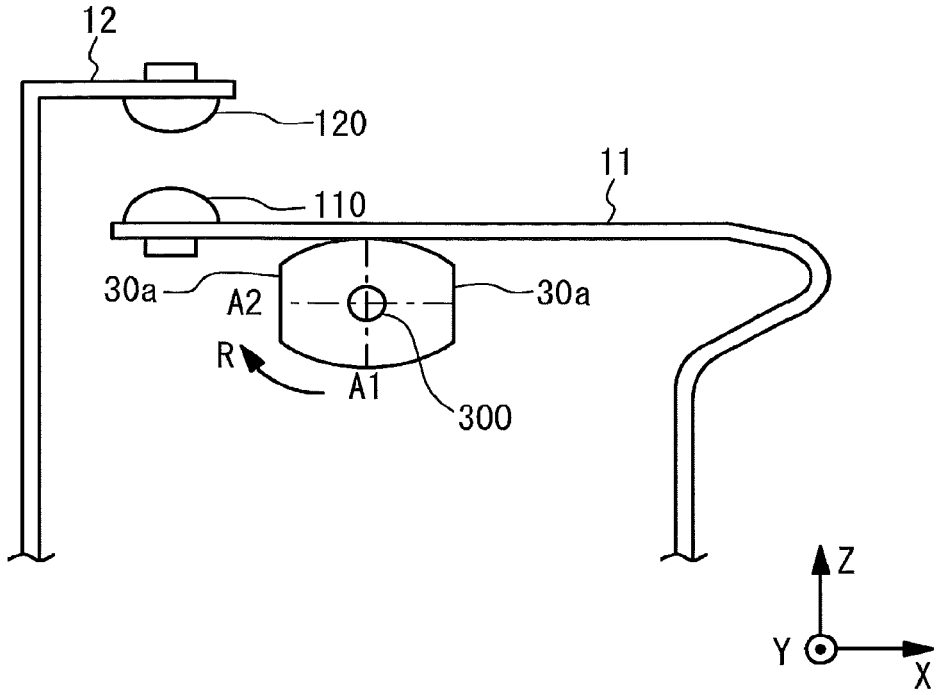
FIG. 10 is a side view illustrating the fixed terminal, the movable terminal, and the cams when the relay of a variation example is in the off-state.
Figure 11:
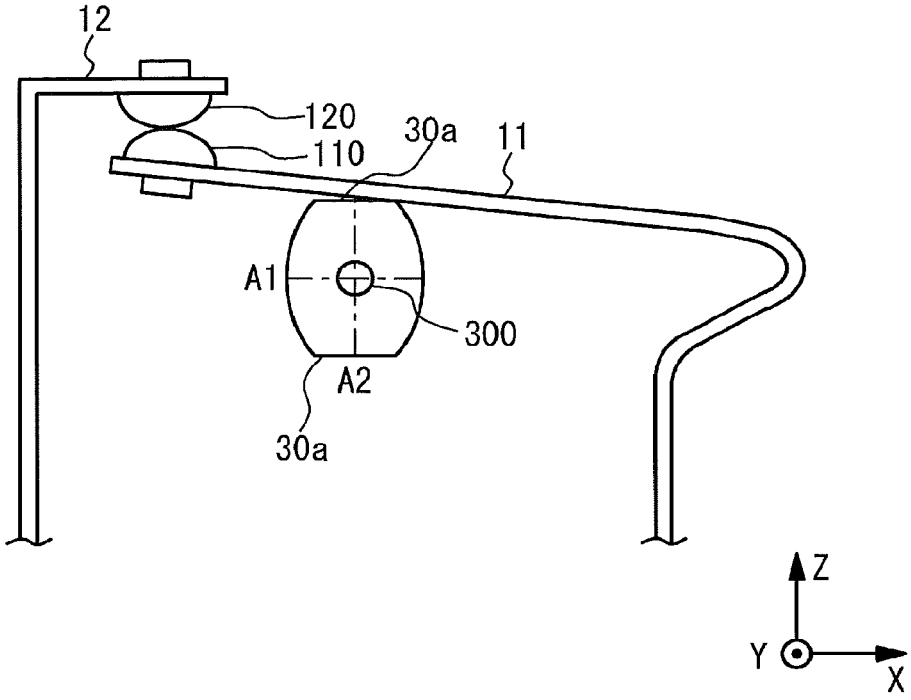
FIG. 11 is a side view illustrating the fixed terminal, the movable terminal, and the cams when the relay of the variation example is in the on-state.

Here, a maintain unit for maintaining the on-state and the off-state of the relay 1*a* is not limited to the above-mentioned mechanism. FIGS. 10 and 11 are side views illustrating the fixed terminal 12, the movable terminal 11, and the cams 30 when the relay of a variation example is in the off-state and the on-state, respectively.

In the variation example, each cam 30 has flat portions 30*a* which are located at both ends of the major axis A2 of the elliptical circumference shape. Therefore, when the relay 1*a* is in the on-state, each cam 30 can maintain the movable terminal 11 by the flat portions 30*a* so that the contact state of the movable contact 110 and the fixed contact 120 is maintained. Here, when each cam 30 can rotate in a clockwise direction and a counterclockwise direction, a single flat portion 30*a* may be provided only at one end of the major axis A2.

Figure 12:
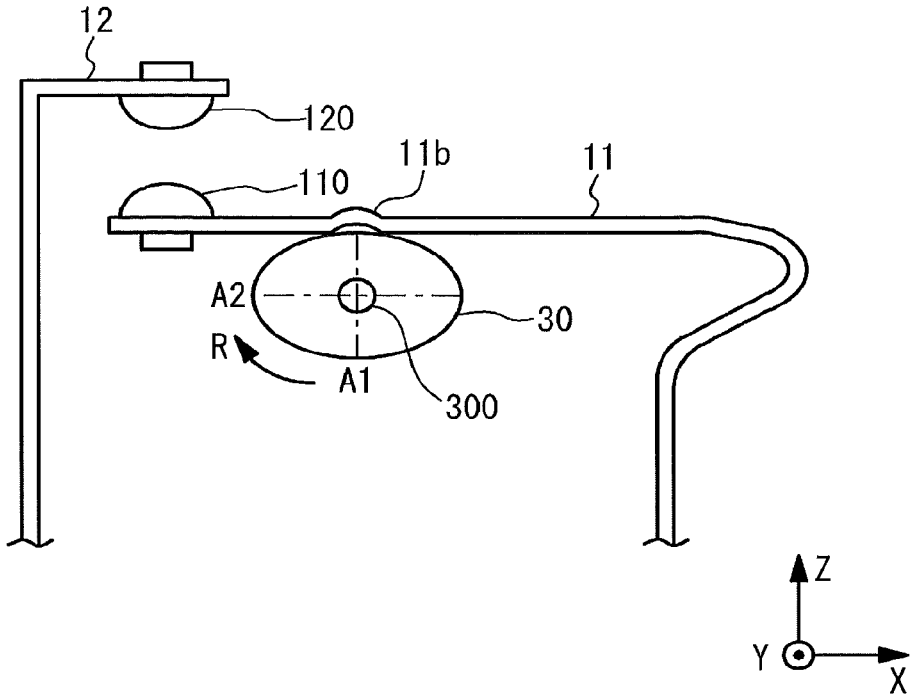
FIG. 12 is a side view illustrating the fixed terminal, the movable terminal, and the cams when the relay of another variation example is in the off-state.
Figure 13:
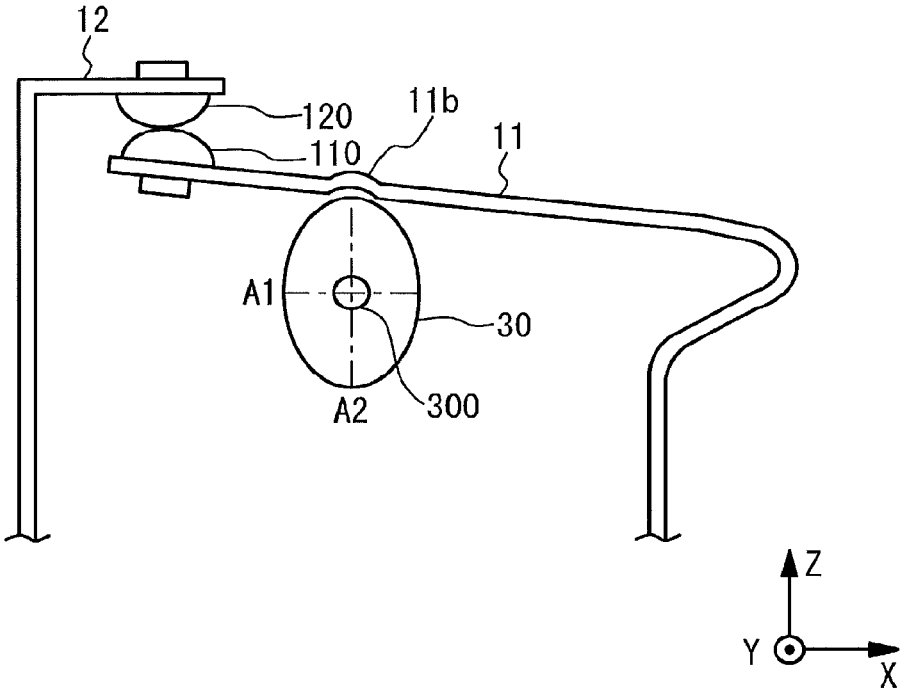
FIG. 13 is a side view illustrating the fixed terminal, the movable terminal, and the cams when the relay of the another variation example is in the on-state.

FIGS. 12 and 13 are side views illustrating the fixed terminal 12, the movable terminal 11, and the cams 30 when the relay 1*a* of another variation example is in the off-state and the on-state, respectively.

In the another variation example, the movable terminal 11 has a recess 11*b* which fits one end of the major axis A2 of the elliptical circumference shape of each cam 30 therein. When the relay 1*a* is in the on-state, the one end of the major axis A2 of the elliptical circumference shape is fitted in recess 11*b*. Therefore, each cam 30 can maintain the movable terminal 11 so that the contact state of the movable contact 110 and the fixed contact 120 is maintained.

As described above, the relay 1*a* of the present embodiment includes the fixed terminal 12, the movable terminal 11, the cams 30 and the driving unit (i.e., the coil 20 and the extrusion member 21). On the fixed terminal 12, the fixed contact 120 is provided. On the movable terminal 11, the movable contact 110 is provided. Each of the cams 30 has the elliptical circumference shape, and can rotate while a portion of the circumference shape is contacting the board surface of the movable terminal 11.

The driving unit rotates the cams 30 so that the respective portions of each cam 30 located at one ends of the major axis A2 and the minor axis A1 of the elliptical circumference shape alternately contact the board surface of the movable terminal 11. When the portion located at one end of the major axis A2 of the elliptical circumference shape of each cam 30 contacts the board surface of the movable terminal 11, the movable terminal 11 is deformed elastically so that the movable contact 110 contacts the fixed contact 120.

According to the relay 1*a* of the present embodiment, it is possible to switch the contact state and the non-contact state of the movable contact 110 and the fixed contact 120 by switching the angle of the cams 30 by the driving unit. Therefore, the relay 1*a* of the present embodiment can maintain the contact state of the movable contact 110 and the fixed contact 120 with no energization, without using expensive parts such as the permanent magnet and the ratchet mechanism, and hence the manufacturing cost of the relay 1*a* is reduced.

Second Embodiment

Figure 14:
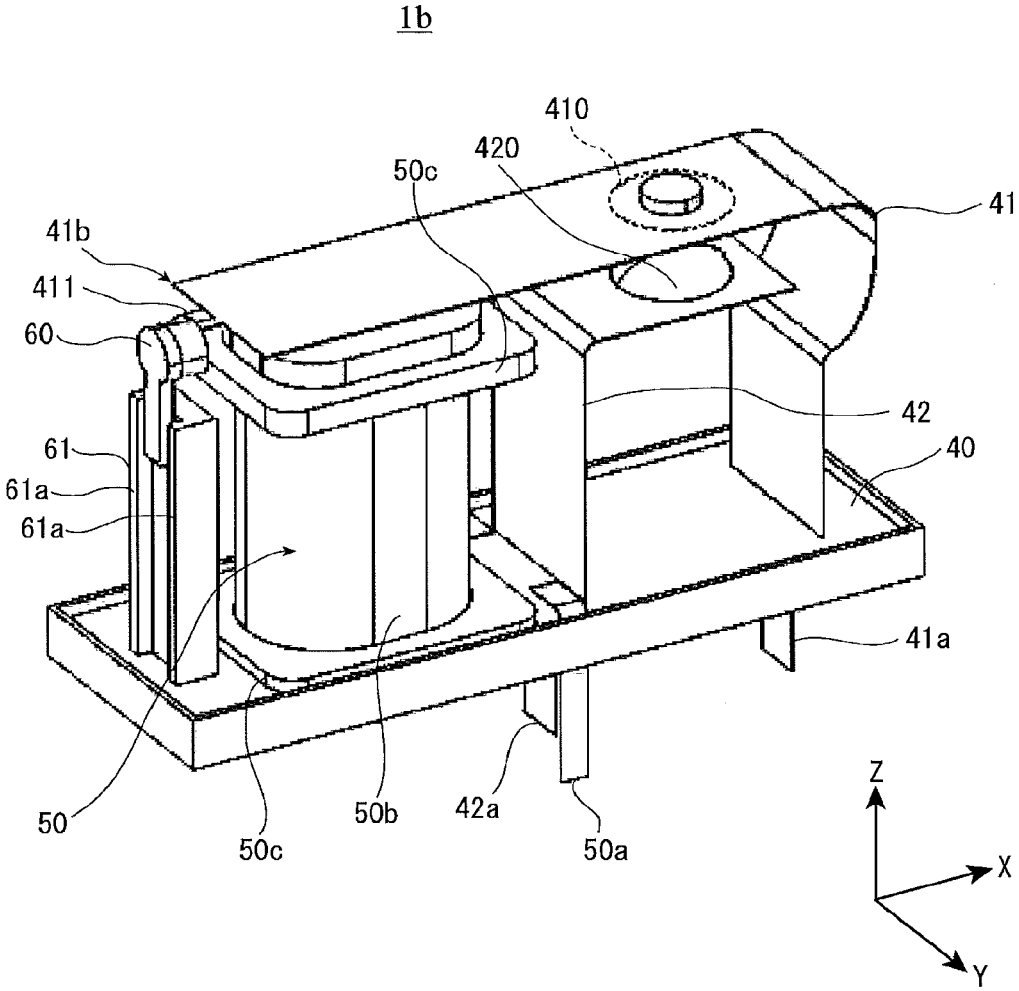
FIG. 14 is a perspective view of a relay according to a second embodiment.
Figure 15:
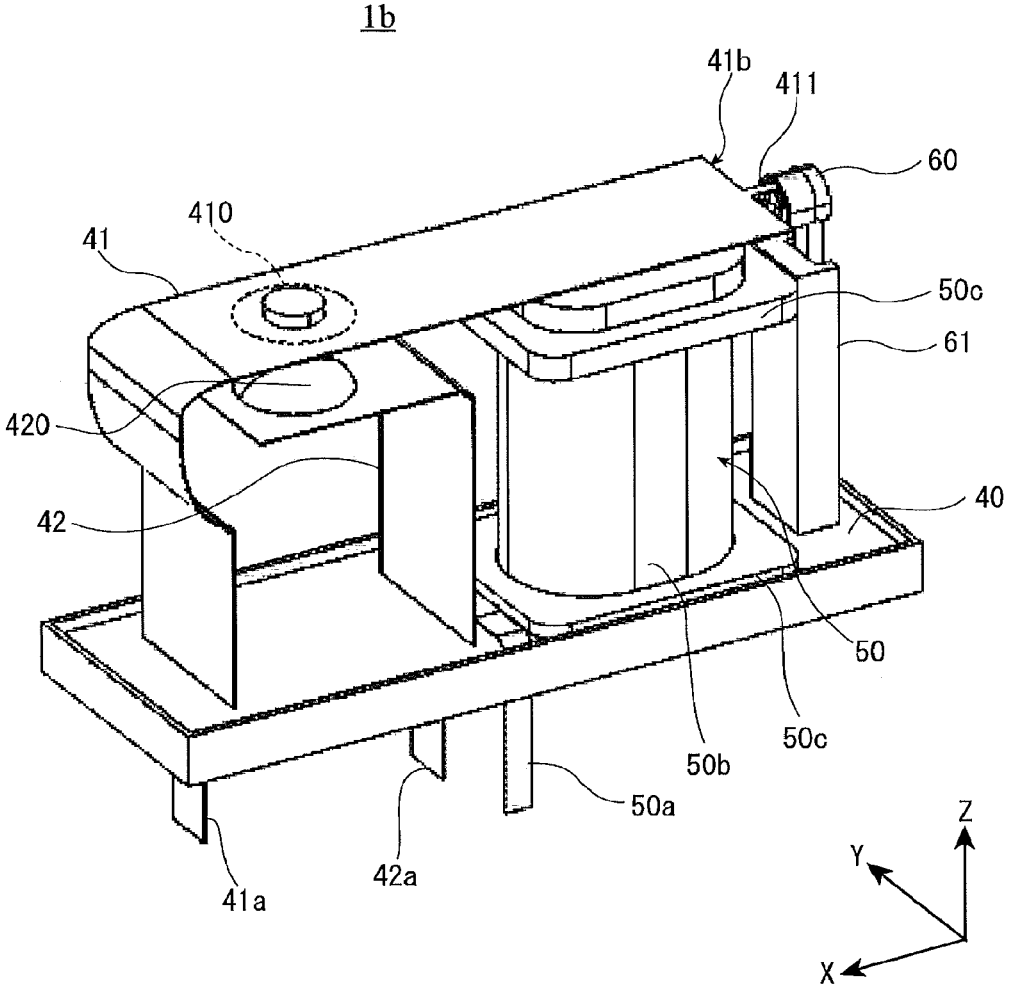
FIG. 15 is a perspective view of the relay according to the second embodiment, as viewed from an opposite side of FIG. 14.

FIG. 14 is a perspective view of a relay according to a second embodiment. FIG. 15 is a perspective view of the relay according to the second embodiment, as viewed from an opposite side of FIG. 14. A relay 1*b* includes a base 40, a movable terminal 41, a fixed terminal 42, a coil 50, a guide member 60, and a pillar 61. Here, directions of an X-axis, a Y-axis and a Z-axis illustrated in FIGS. 14 and 15 are defined as a front-and-back direction, a right-and-left direction, and an up-and-down direction, respectively.

The base 40 supports the movable terminal 41, the fixed terminal 42, the coil 50, and the pillar 61. The base 40 is formed, for example in the shape of a rectangle board by an insulator, such as rubber.

The coil 50 includes a pair of terminals 50*a*, a winding unit 50*b*, and a pair of flange units 50*c*. One of the pair of flange units 50*c* is fixed on the base 40. The winding unit 50*b* is provided between the pair of flange units 50*c*, and is configured so that a conductive wire is wound around the circumference of a core. Both ends of the conductive wire of the winding unit 20*b* are electrically connected to the pair of terminals 50*a* projected from an undersurface side of the base 40. Therefore, the coil 50 generates a magnetic field by energization from the pair of terminals 50*a*. The magnetic field acts as a suction force to attract the movable terminal 41 to the coil 50.

The fixed terminal 42 is an L-shaped conductive board stood on the base 40. An external connection terminal 42*a* extending from one end of a lower part of the fixed terminal 42 passes through the base 40 and is projected from the undersurface side of the base 40. Moreover, a dome-shaped fixed contact 420 is provided on a board surface of the fixed terminal 42 parallel to the base 40.

The movable terminal 41 is an L-shaped conductive board stood on the base 40. An external connection terminal 41*a* extending from one end of a lower part of the movable terminal 41 passes through the base 40 and is projected from the undersurface side of the base 40. Moreover, a dome-shaped movable contact 410 is provided near a bending portion of the movable terminal 41 and under a board surface of the movable terminal 41 parallel to the base 40 so as to be opposed to the fixed contact 420. When the suction force of the coil 50 is generated, the movable contact 410 moves downward by elastic deformation of the movable terminal 41, and contacts the fixed contact 420. That is, the movable terminal 41 is deformed elastically by the suction force of the coil 50 so that the movable contact 410 contacts the fixed contact 420.

Figure 16:
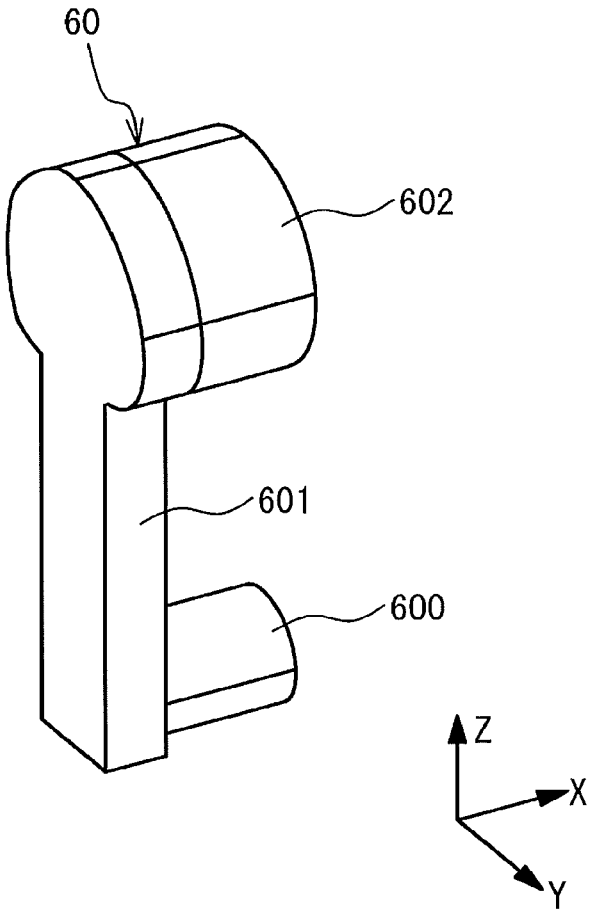
FIG. 16 is a perspective view of a guide member.
Figure 17:
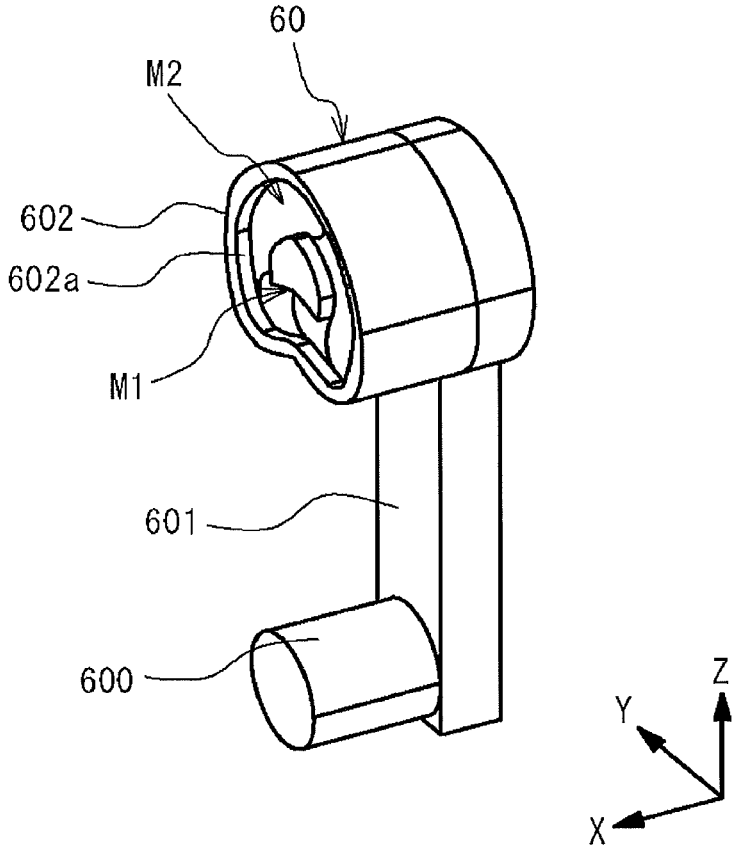
FIG. 17 is a perspective view of the guide member, as viewed from an opposite side of FIG. 16.

The pillar 61 is stood on the base 40, and supports the guide member 60. FIG. 16 is a perspective view of the guide member 60, and FIG. 17 is a perspective view of the guide member 60, as viewed from an opposite side of FIG. 16.

The guide member 60 includes a rotary shaft 600, an arm unit 601, and a swing unit 602. The rotary shaft 600 and the swing unit 602 are provided on both ends of the pillar-shaped arm unit 601, respectively. The rotary shaft 600 is inserted into a hole formed on a top of the pillar 61 so that the swing unit 602 is located on a top surface of the pillar 61. The swing unit 602 swings about the rotary shaft 600 in a right-and-left direction like a pendulum. The swing range of the swing unit 602 is limited by a pair of convex portions 61*a* (see FIG. 14) formed on the pillar 61 along the up-and-down direction.

The swing unit 602 is the pillar-shaped member having an upside-down approximately heart shape, and a guide groove 602*a* is formed on a surface of the swing unit 602 opposed to a rear end 41*b* (hereinafter simply referred to as "end") of the movable terminal 41. The guide member 60 guides the end 41*b* of the movable terminal 41 along the guide groove 602*a*. More specifically, the end 41*b* of the movable terminal 41 has a projection 411. The projection 411 is fitted into the guide groove 602*a*, and moves along the guide groove 602*a*. At this time, since the swing unit 602 swings in the right-and-left direction, the projection 411 can pass through a curved domain of the guide groove 602*a* while reducing the twist of the movable terminal 41.

A first locking unit M1 and a second locking unit M2 are provided on the guide groove 602*a*. The first locking unit M1 locks the end 41*b* of the movable terminal 41 when the movable contact 410 contacts the fixed contact 420. The second locking unit M2 locks the end 41*b* of the movable terminal 41 when the movable contact 410 separates from the fixed contact 420. The first locking unit M1 and the second locking unit M2 are two peaks in a route of the guide groove 602*a*. The first locking unit M1 and the second locking unit M2 prevent the upward movement of the projection 411 by the action of the restoring force of the movable terminal 41 which is elastically deformed, and hence lock the end 41*b* of the movable terminal 41. The detailed composition of the guide groove 602*a* is mentioned later.

Figure 18:
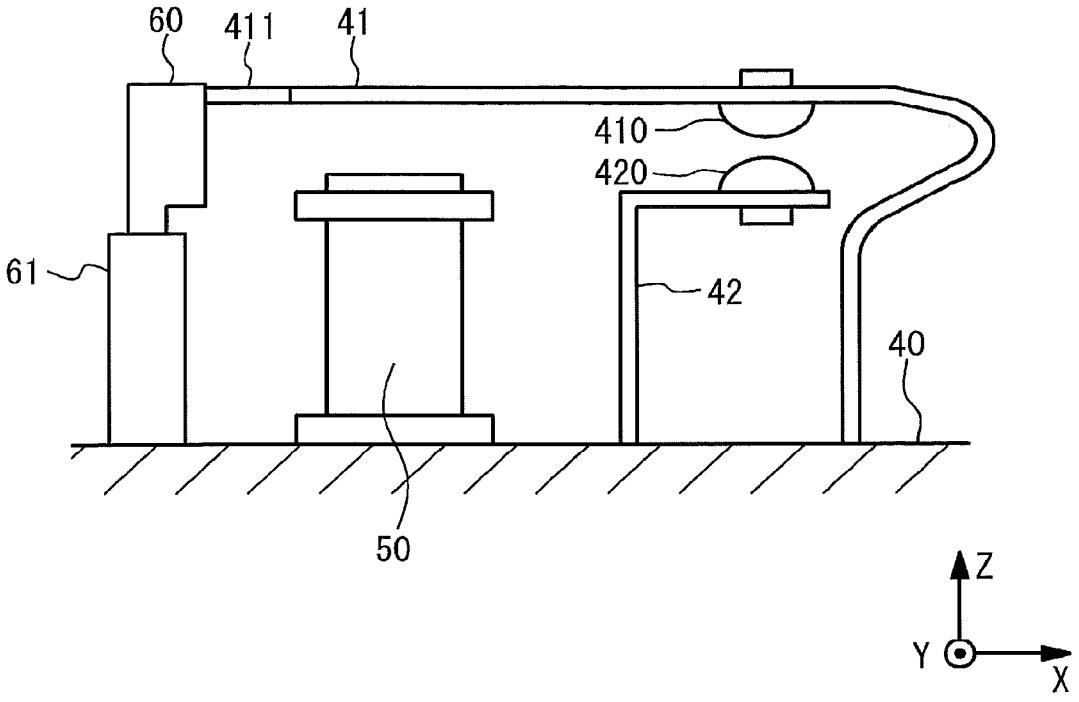
FIG. 18 is a side view illustrating the relay in the off-state.
Figure 19:
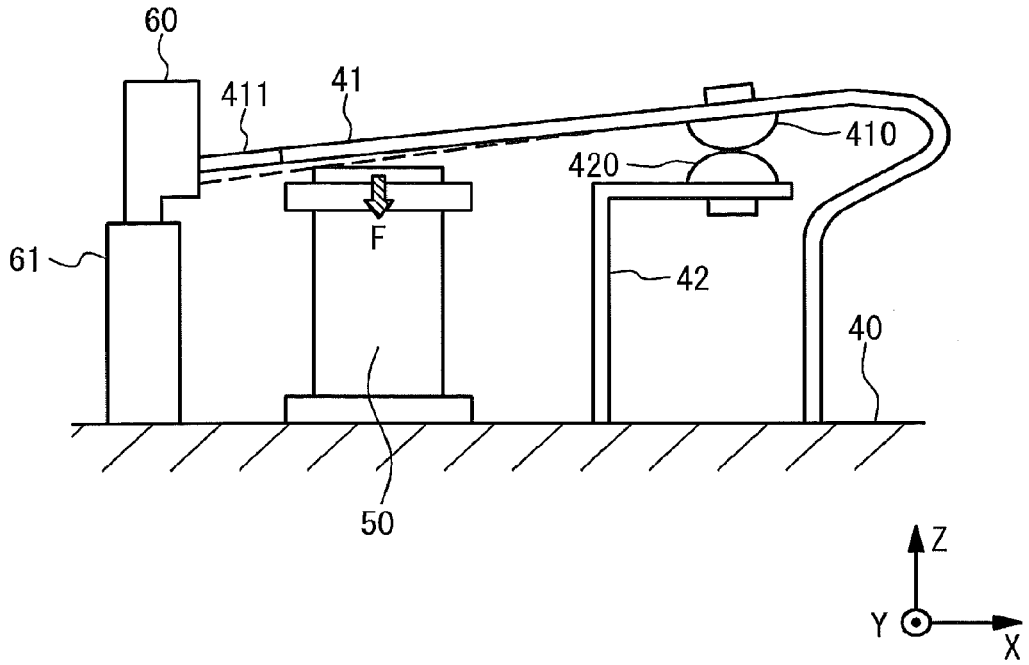
FIG. 19 is a side view illustrating the relay in the on-state.

FIGS. 18 and 19 are side views illustrating the relay 1*b* in the off-state and the on-state, respectively. In the off-state illustrated in FIG. 18, the movable contact 410 and the fixed contact 420 are held at a fixed interval. The projection 411 is locked to the second locking unit M2 of the guide groove 602*a* according to the fixed restoring force which arises in the movable terminal 41.

On the other hand, in the on-state illustrated in FIG. 19, the movable terminal 41 is deformed elastically by the suction force F which arises by the energization of the coil 50, and is once attracted to a position illustrated by a dotted line. Thereby, the movable contact 410 and the fixed contact 420 contact mutually.

Then, when the energization to the coil 50 is stopped, the projection 411 moves upward by the restoring force of the movable terminal 41, and is locked to the first locking unit M1 of the guide groove 602*a*. For this reason, the movable terminal 41 does not return to a position illustrated in FIG. 18, and is held in a position illustrated by a solid line of FIG. 19. At this time, in the movable terminal 41, only a rear portion of the movable contact 410 (i.e., a portion near the end 41*b*) is deformed for the limitation of height position of the first locking unit M1, the contact state of the movable contact 410 and the fixed contact 420 is maintained. That is, the height position of the first locking unit M1 is determined so that the movable contact 410 and the fixed contact 420 do not become the non-contact state by the restoring force of the movable terminal 41.

Figure 20:
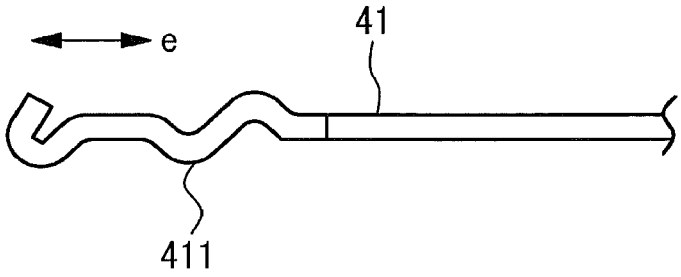
FIG. 20 is a side view illustrating an example of a projection provided on an end of the movable terminal.

FIG. 20 is a side view illustrating an example of the projection 411 provided on the end 41*b* of the movable terminal 41. The end 41*b* of the movable terminal 41 includes the projection 411 with a spring characteristic, and the projection 411 is extended so as to push the bottom of the guide groove 602*a*. The projection 411 can be expanded and contracted in the front-and-back direction (see a mark "e"). Since the projection 411 pushes the bottom of the guide groove 602*a*, the projection 411 does not separate from the guide groove 602*a* by disturbance, such as a shock and vibration.

Figure 21:
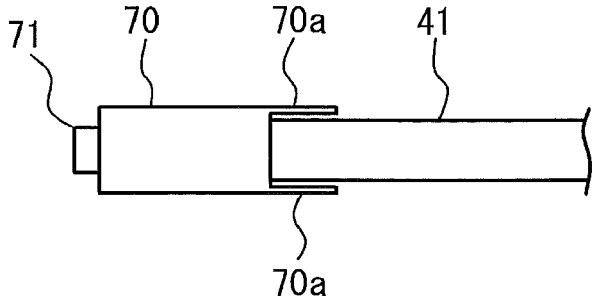
FIG. 21 is a side view illustrating an example of a guide assist member mounted on the end of the movable terminal.
Figure 22:
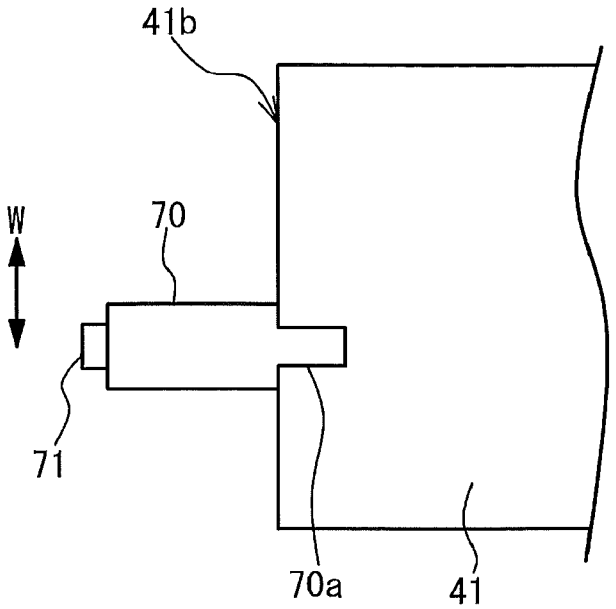
FIG. 22 is a top view illustrating an example of the guide assist member mounted on the end of the movable terminal.

Instead of the projection 411 described above, a guide assist member for assisting the guidance may be mounted on the end 41*b* of the movable terminal 41. FIGS. 21 and 22 are a side view and a top view illustrating an example of the guide assist member mounted on the end 41*b* of the movable terminal 41, respectively.

A guide assist member 70 has a cylindrical shape. A pair of tabular portions 70*a* extended from one ends of the cylindrical shape sandwiches the end 41*b* of the movable terminal 41, so that the guide assist member 70 is mounted on the movable terminal 41. According to the attachment structure, the guide assist member 70 can freely slide along the end 41*b* of the movable terminal 41 (see a mark "w"). Therefore, the guide assist member 70 slides in the right-and-left direction according to the movement of the end 41*b* of the movable terminal 41 in the up-and-down direction, and hence the twist of the movable terminal 41 by the swing of the guide member 60 is reduced.

Figure 23:
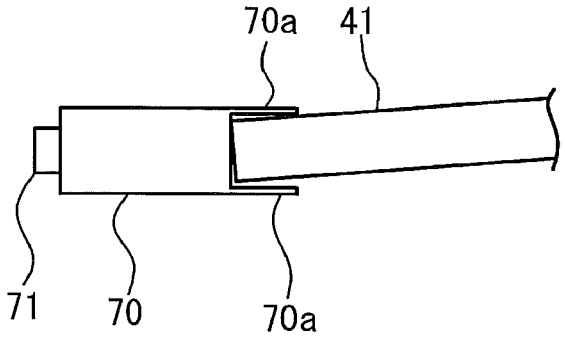
FIG. 23 is a side view illustrating the guide assist member when the relay is in on-state.

FIG. 23 is a side view illustrating the guide assist member 70 when the relay 1*b* is in on-state. Gaps exist between the pair of tabular portions 70*a* and the end 41*b*. When the relay 1*b* is in on-state (see FIG. 19), even if the board surface of the movable terminal 41 inclines against the bottom of the guide groove 602*a*, the guide assist member 70 does not incline for the gaps, and the posture of the projection 71 is perpendicularly maintained with respect to the bottom of the guide groove 602*a*.

Figure 24:
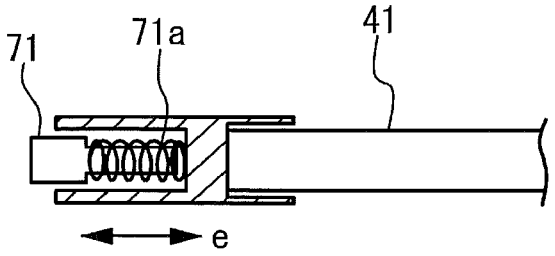
FIG. 24 is a cross-section view of the guide assist member.

FIG. 24 is a cross-section view of the guide assist member 70. The guide assist member 70 includes the projection 71, and a spring 71*a* (elastic member) which extends so as to push the projection 71 to the bottom of the guide groove 602*a*. The projection 71 and the spring 71*a* are provided in the cylinder of the guide assist member 70. The spring 71*a* can be expanded and contracted in the front-and-back direction (see a mark "e"). The projection 71 is pushed to the bottom of the guide groove 602*a* by the elasticity of the spring 71*a*. Therefore, the projection 71 does not separate from the guide groove 602*a* by disturbance, such as a shock and vibration. Here, instead of the spring 71*a*, another elastic member such as rubber may be employed.

Figure 25:
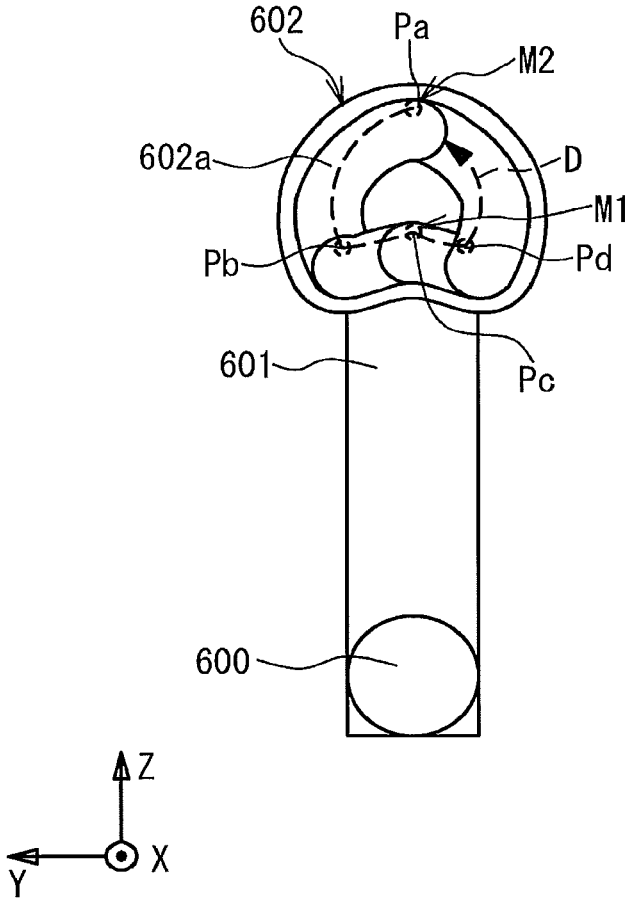
FIG. 25 is a front view of the guide assist member.
Figure 26:
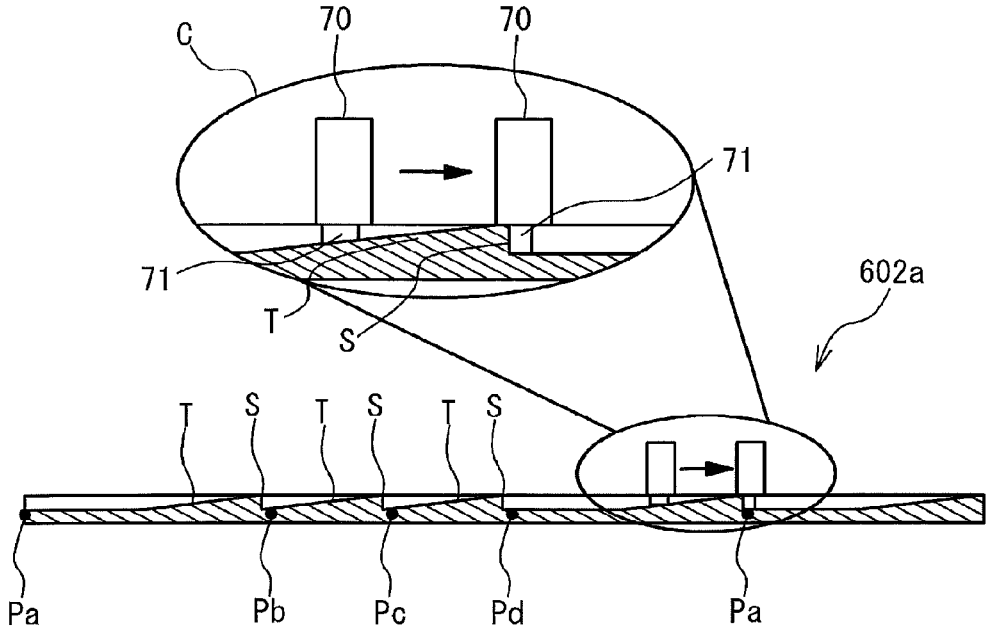
FIG. 26 is a cross-section view illustrating an expanded cross-section surface of a guide groove.

Next, the composition of the guide groove 602*a* is explained with reference to FIGS. 25 and 26. FIG. 25 is a front view of the guide member 60. FIG. 26 is a cross-section view illustrating an expanded cross-section surface of a guide groove 602*a*.

The guide groove 602*a* includes an upside-down approximately heart-shaped route. When the relay 1*b* is changed from the off-state to the on-state, the projection 411 or 71 moves the inner side of the guide groove 602*a* in order of a position Pa, a position Pb, and a position Pc. On the other hand, when the relay 1*b* is changed from the on-state to the off-state, the projection 411 or 71 moves the inner side of the guide groove 602*a* in order of the position Pc, a position Pd, and the position Pa.

The positions Pa and Pc are set to an apex portion and a concave portion of the heart shape, and are identical with the positions of the above-mentioned first locking unit M1 and the above-mentioned second locking unit M2, respectively. The positions Pb and Pd are located at the right and left of the position Pc, and are set to two evagination portions of the heart shape. The energization to the coil 50 is turned on or off in each of the positions Pa to Pd, so that the projection 411 or 71 moves along a given traveling direction D.

A bottom portion of the guide groove 602*a* includes a plurality of steps S which prevent the projection 411 or 71 from advancing in a direction opposite to the given traveling direction D, and a plurality of inclines T which extend between the respective steps S. That is, a cross-section surface of the bottom portion of the guide groove 602*a* is a saw-tooth shape.

The positions Pa to Pd adjoin the steps S, respectively. While the projection 411 or 71 is moving from one of the positions Pa to Pd to a next one of the positions Pa to Pd along the traveling direction D as illustrated in an enlarged section C of FIG. 26, the projection 411 or 71 is pushed by the rising of the bottom portion by the inclines T, so that the length of the projection 411 or 71 shortens. When the projection 411 or 71 passes through one of the steps S and reaches the next one of the positions Pa to Pd, the bottom portion lowers suddenly, and hence the projection 411 or 71 extends by the elasticity. Therefore, advancing the projection 411 or 71 in the direction opposite to the traveling direction D is disturbed by each step S. Although only the situation of the projection 71 is illustrated in FIG. 26, the situation of the projection 411 is the same as that of the projection 71.

Figure 27:
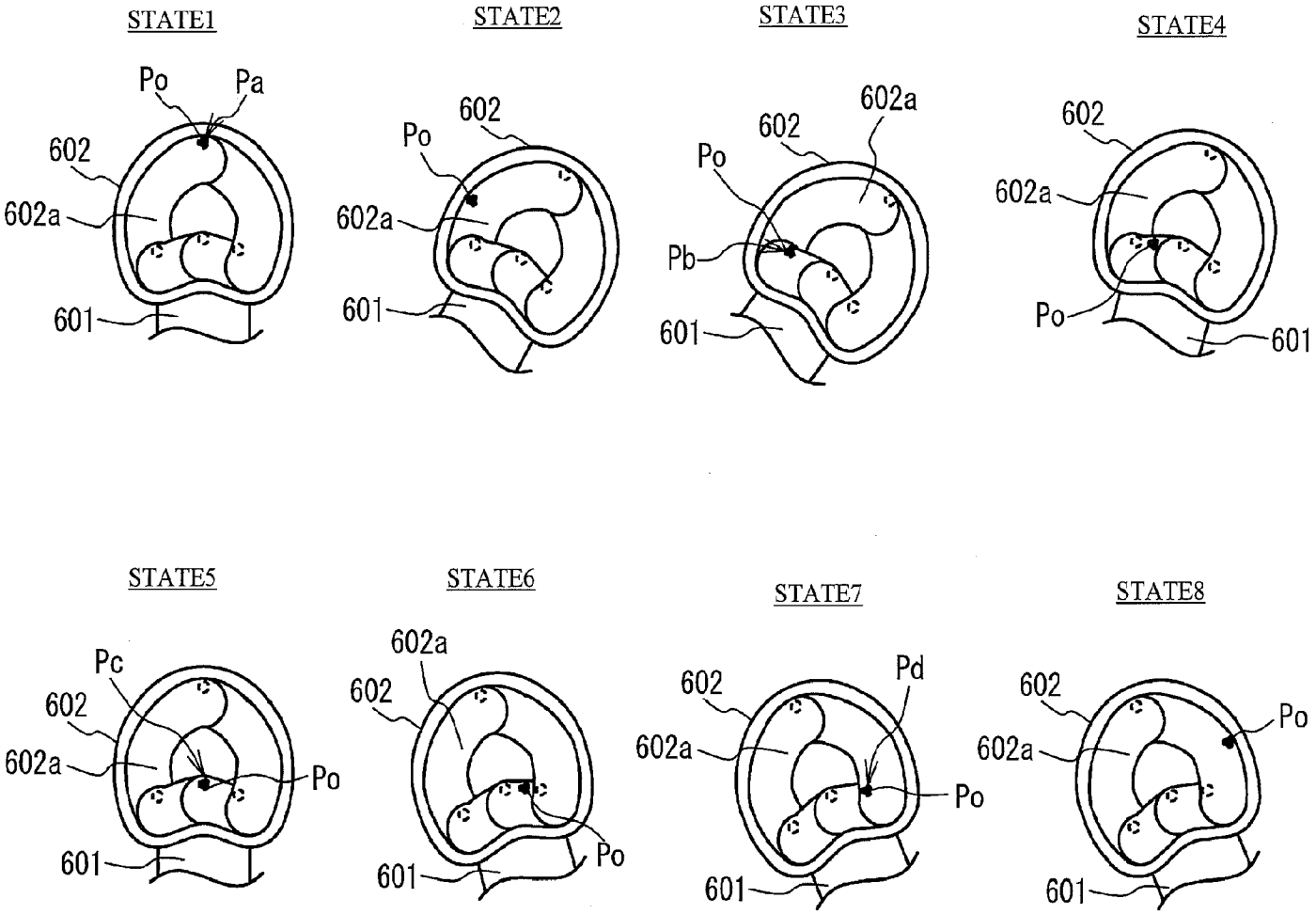
FIG. 27 is a diagram illustrating states where the projection is moved in the guide groove stepwise.

FIG. 27 is a diagram illustrating states where the projection 411 or 71 is moved in the guide groove 602*a* stepwise. In FIG. 27, a mark "Po" indicates the position of the projection 411 or 71.

A state 1 indicates a case where the relay 1*b* is in the off-state and the coil 50 is in a non-energization state. At this time, a force acts on the projection 411 or 71 upward by the restoring force of the movable terminal 41, and the projection 411 or 71 is held in the position Pa of the apex portion. Thereby, the end 41*b* of the movable terminal 41 is locked to the second locking unit M2.

A state 2 indicates a case where the relay 1*b* is in the off-state and the energization to the coil 50 is started. Since the movable terminal 41 is attracted downward by the suction force F of the coil 50, a force acts on the projection 411 or 71 downward, and the projection 411 or 71 begins moving toward the next position Pb according to the traveling direction D. At this time, the projection 411 or 71 does not move towards the position Pd of the opposite side for the steps S. The guide member 60 swings and inclines according to the movement of the projection 411 or 71. This operation is executed also in the following states.

A state 3 indicates a case where the relay 1*b* is in the on-state and the coil 50 is in an energization state (see the dotted line of FIG. 19). The projection 411 or 71 is in the position Pb. At this time, the end 41*b* of the movable terminal 41 moves downward, and the movable contact 410 and the fixed contact 420 become the contact state.

A state 4 indicates a case where the relay 1*b* is in the on-state and the energization to the coil 50 is stopped. A force acts on the projection 411 or 71 upward by the restoring force of the movable terminal 41, and the projection 411 or 71 begins moving toward the next position Pc according to the traveling direction D. At this time, the projection 411 or 71 does not move towards the position Pa of the opposite side for the steps S.

A state 5 indicates a case where the relay 1*b* is in the on-state and the coil 50 is in the non-energization state (see the solid line of FIG. 19). The projection 411 or 71 is in the position Pc of the concave portion. The end 41*b* of the movable terminal 41 is locked to the first locking unit M1 by the upward restoring force. Moreover, the contact state of the movable contact 410 and the fixed contact 420 is maintained.

A state 6 indicates a case where the relay 1*b* is in the on-state and the energization to the coil 50 is started. Since the movable terminal 41 is attracted by the suction force F of the coil 50, a force acts on the projection 411 or 71 downward, and the projection 411 or 71 begins moving toward the next position Pd according to the traveling direction D. At this time, the projection 411 or 71 does not move towards the position Pb of the opposite side for the steps S.

A state 7 indicates a case where the relay 1*b* is in the on-state and the coil 50 is in the energization state. The projection 411 or 71 is in the position Pd. At this time, the contact state of the movable contact 410 and the fixed contact 420 is maintained.

A state 8 indicates a case where the relay 1*b* is in the on-state and the energization to the coil 50 is stopped. A force acts on the projection 411 or 71 upward by the restoring force of the movable terminal 41, and the projection 411 or 71 begins moving toward the next position Pa according to the traveling direction D. At this time, the projection 411 or 71 does not move towards the position Pc of the opposite side for the steps S. Moreover, the contact state of the movable contact 410 and the fixed contact 420 is maintained. Then, the projection 411 or 71 returns to the state 1 again, and the same movement process as the contents mentioned above is performed.

Thus, the projection 411 or 71 is guided along the guide groove 602*a* in which the traveling direction D is regulated by the steps S and the inclines T, and is held at the suitable position Pa or Pc by the restoring force of the movable terminal 41. Therefore, the end 41*b* of the movable terminal 41 is locked to the first locking unit M1 when the movable contact 410 and the fixed contact 420 mutually contact. The end 41*b* of the movable terminal 41 is locked to the second locking unit M2 when the movable contact 410 separates from the fixed contact 420. The guide means and the locking means for the end 41*b* of the movable terminal 41 are not limited to the above-mentioned composition.

In the present embodiment, since the rotary shaft 600 of the guide member 60 is away from the swing unit 602, the rotary angle of the guide member 60 at the time of the swing of the guide member 60 is restrained according to the movement of the up-and-down direction of the end 41*b* of the movable terminal 41, and the guide operation is stabilized. However, unlike this, the rotary shaft 600 of the guide member 60 may be provided at the center of the swing unit 602.

Figure 28:
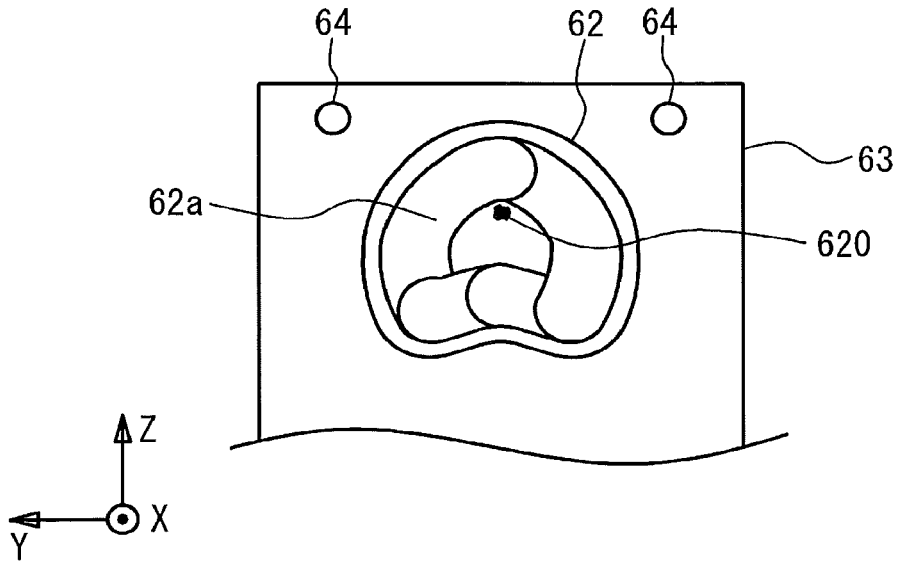
FIG. 28 is a front view illustrating a variation example of the guide member.

FIG. 28 is a front view illustrating a variation example of the guide member. A guide member 62 has a guide groove 62*a* and the same shape as the above-mentioned swing unit 602. A rotary shaft 620 is provided in a central portion of a surface on which the guide groove 62*a* is formed. The rotary shaft 620 is inserted into a hole of a pillar 63 (corresponding to the above-mentioned pillar 61), and the guide member 62 rotates about the rotary shaft 620 according to the movement of the up-and-down direction of the end 41*b* of the movable terminal 41.

In order to regulate the rotary angle, a pair of projecting portions 64 are provided at the right and left of an upper portion of the guide member 62 in the pillar 63. The pair of projecting portions 64 restrains the rotary angle of the guide member 62 by contacting side portions of the rotated guide member 62, and stabilizes the guide operation. In the guide member 62 of this example, the arm unit 601 is not required, compared with the above-mentioned guide member 60. Therefore, the guide member 62 is downsized.

As described above, the relay 1*b* includes the coil 50, the fixed terminal 42, the movable terminal 41, and the guide member 60 or 62. The coil 50 generates the suction force F by the energization. The fixed contact 420 is provided on the fixed terminal 42, and the movable contact 410 is provided on the movable terminal 41. The movable contact 410 is deformed elastically so as to contact the fixed contact 420 by the suction force F.

The guide member 60 or 62 guides the end 41*b* of the movable terminal 41 along the guide groove 602*a* or 62*a*, respectively. The first locking unit M1 and the second locking unit M2 are provided on the guide grooves 602*a* and 62*a*. The first locking unit M1 locks the end 41*b* of the movable terminal 41 when the movable contact 410 contacts the fixed contact 420. The second locking unit M2 locks the end 41*b* of the movable terminal 41 when the movable contact 410 separates from the fixed contact 420.

According to the relay 1*b* of the present embodiment, the end 41*b* of the movable terminal 41 is guided along the guide groove 602*a* or 62*a* by the guide member 60 or 62, respectively. When the movable contact 410 contacts the fixed contact 420, i.e., the relay 1*b* becomes the on-state, the end 41*b* of the movable terminal 41 is locked by the first locking unit M1 provided on the guide groove 602*a*. On the contrary, when the movable contact 410 separates from the fixed contact 420, i.e., the relay 1*b* becomes the off-state, the end 41*b* of the movable terminal 41 is locked by the second locking unit M2 provided on the guide groove 602*a*.

Therefore, according to the relay 1*b* of the present embodiment, the end 41*b* of the movable terminal 41 is guided and locked to the first locking unit M1 or the second locking unit M2 by the guide member 60 or 62, and hence the contact state and the non-contact state of the movable contact 110 and the fixed contact 120 can be switched. Therefore, the relay 1*b* of the present embodiment can maintain the contact state of the movable contact 410 and the fixed contact 420 without energization and without using expensive parts such as the permanent magnet and the ratchet mechanism. Accordingly, the manufacturing cost of the relay 1*b* is reduced.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A relay comprising:

a fixed terminal on which a fixed contact is provided;

a movable terminal on which a movable contact is provided;

a cam that has an elliptical circumference shape, and is rotatable while a portion of the circumference shape is contacting a surface of the movable terminal;

an impeller operatively connected to the cam; and a driving unit that rotates the cam so that respective portions located at one ends of a first axis and a second axis of the elliptical circumference shape alternately contact the surface of the movable terminal;

wherein when the portion located at one end of the first axis of the elliptical circumference shape of the cam contacts the surface of the movable terminal, the movable terminal is deformed elastically so that the movable contact contacts the fixed contact, and wherein the driving unit includes a member that is deformed elastically to move the impeller and the cam a predetermined angle, and wherein the cam and the impeller are arranged on a rotary shaft, and the deformed member abuts and rotates the impeller to rotate the cam the predetermined angle.

2. The relay as claimed in claim 1, wherein the cam has a flat portion which is located at one end of the major axis of the elliptical circumference shape.

3. The relay as claimed in claim 1, wherein the movable terminal has a recess which fits one end of the major axis of the elliptical circumference shape in.

4. The relay as recited in claim 1, wherein the cam is two cams spaced along the rotary shaft with the impeller positioned between the two cams.

5. The relay as recited in claim 4, wherein the impeller is first and second impellers along the rotary shaft, each impeller having a plurality of blades.

6. The relay as recited in claim 4, wherein the plurality of blades on each of the first and second impellers is four, each spaced 90 degrees from each other.

7. The relay as recited in claim 6, wherein the blades of the first impeller are spaced 45 degrees relative to the blades of the second impeller.

8. The relay as recited in claim 5, wherein the member includes first and second projections, each projecting at a different length from the member, wherein the first projection contacts the blades of the first impeller and the second projection contacts the blades of the second impeller.

9. A relay comprising:

a fixed terminal on which a fixed contact is provided;

a movable terminal on which a movable contact is provided;

a cam that has an elliptical circumference shape, and is rotatable while a portion of the circumference shape is contacting a surface of the movable terminal; and a driving unit that rotates the cam so that respective portions located at one ends of a major axis and a minor axis of the elliptical circumference shape alternately contact the surface of the movable terminal;

wherein when the portion located at one end of the major axis of the elliptical circumference shape of the cam contacts the surface of the movable terminal, the movable terminal is deformed elastically so that the movable contact contacts the fixed contact, wherein the cam is equipped with an impeller rotatably attached to a rotary shaft, and wherein the driving unit includes a coil, and an extrusion member that is deformed elastically by a suction force generated whenever the coil is energized, and pushes a blade of the impeller so that the impeller is rotated by a predetermined angle.

10. The relay as recited in claim 9, wherein the extrusion member abuts and rotates the impeller to rotate the cam the predetermined angle.

11. The relay as recited in claim 9, wherein the cam is two cams spaced along the rotary shaft.

12. The relay as recited in claim 10, wherein the impeller is first and second impellers along the rotary shaft, each impeller having a plurality of blades.

13. The relay as recited in claim 12, wherein the plurality of blades on each of the first and second impellers is four, each spaced 90 degrees from each other.

14. The relay as recited in claim 13, wherein the blades of the first impeller are spaced 45 degrees relative to the blades of the second impeller.

15. The relay as recited in claim 12, wherein the extrusion member includes first and second projections, each projecting at a different length from the extrusion member, wherein the first projection contacts the blades of the first impeller and the second projection contacts the blades of the second impeller.

16. A relay comprising:

a fixed terminal on which a fixed contact is provided;

a movable terminal on which a movable contact is provided;

a cam that has an elliptical circumference shape, and is rotatable while a portion of the circumference shape is contacting a surface of the movable terminal; and a driving unit that rotates the cam so that respective portions located at one ends of a first axis and a second axis of the elliptical circumference shape alternately contact the surface of the movable terminal;

wherein when the portion located at one end of the first axis of the elliptical circumference shape of the cam contacts the surface of the movable terminal, the movable terminal is deformed elastically so that the movable contact contacts the fixed contact, wherein the driving unit includes a coil, and a member that is deformed elastically by a suction force generated whenever the coil is energized, and is operatively connected to the cam to move the cam a predetermined angle, and wherein the cam includes a rotatable impeller, and the deformed member abuts and rotates the impeller to rotate the cam the predetermined angle.

17. The relay as recited in claim 16, wherein the impeller is first and second impellers along a shaft, each impeller having a plurality of blades.

18. The relay as recited in claim 17, wherein the plurality of blades on each of the first and second impellers is four, each spaced 90 degrees from each other.

19. The relay as recited in claim 18, wherein the blades of the first impeller are spaced 45 degrees relative to the blades of the second impeller.

20. The relay as recited in claim 17, wherein the member includes first and second projections, each projecting at a different length from the member, wherein the first projection contacts the blades of the first impeller and the second projection contacts the blades of the second impeller.

* * * * *

UNITED STATES PATENT AND TRADEMARK OFFICE

CERTIFICATE OF CORRECTION

PATENT NO. : 9,330,871 B2
APPLICATION NO. : 14/082513
DATED : May 3, 2016
INVENTOR(S) : Takuya Uchiyama et al.

It is certified that error appears in the above-identified patent and that said Letters Patent is hereby corrected as shown below:

In the claims,
Claim 6, Column 12, Line 46:
Delete "claim 4," and insert -- claim 5, --, therefor.

Signed and Sealed this
Twelfth Day of July, 2016

Michelle K. Lee

Michelle K. Lee
*Director of the United States Patent and Trademark Office*